US007198083B1

(12) United States Patent
Sartena

(10) Patent No.: US 7,198,083 B1
(45) Date of Patent: Apr. 3, 2007

(54) HANDBAG OR THE LIKE WITH COVERED, SEE-THROUGH WALL

(75) Inventor: Stacey Eve Sartena, Smithtown, NY (US)

(73) Assignee: Hair Blast, Inc., Smithtown, NY (US)

( * ) Notice: Subject to any disclaimer, the term of this patent is extended or adjusted under 35 U.S.C. 154(b) by 564 days.

(21) Appl. No.: 10/388,696

(22) Filed: Mar. 14, 2003

Related U.S. Application Data

(63) Continuation-in-part of application No. 10/336,932, filed on Jan. 6, 2003, now Pat. No. 6,637,485.

(51) Int. Cl.
*A45C 3/00* (2006.01)
*A45C 3/06* (2006.01)
*A45C 13/10* (2006.01)

(52) U.S. Cl. ..... 150/118; 150/129; 150/119; 383/106

(58) Field of Classification Search ..... 150/107, 150/119, 118; 190/902
See application file for complete search history.

(56) References Cited

U.S. PATENT DOCUMENTS

| | | | | |
|---|---|---|---|---|
| 244,722 | A | 7/1881 | Knittel | |
| 597,325 | A | 1/1898 | Prickett | |
| 1,359,461 | A * | 11/1920 | Luce | 383/15 |
| 1,464,176 | A * | 8/1923 | Freund | 150/117 |
| 1,842,792 | A * | 1/1932 | Maksik | 150/118 |
| 2,316,328 | A * | 4/1943 | Guenther et al. | 190/124 |
| 2,603,266 | A | 7/1952 | Carroll | |
| 2,723,696 | A | 11/1955 | Kase | |
| RE24,600 | E * | 2/1959 | Ziff | 383/33 |
| 3,182,701 | A | 5/1965 | Ginsburg | |
| 3,556,187 | A | 1/1971 | Speakes | |
| 3,870,132 | A | 3/1975 | Hanley | |
| 3,955,609 | A | 5/1976 | Siegel | |
| 4,022,261 | A | 5/1977 | Russell | |
| 4,112,991 | A | 9/1978 | Barbaresi | |
| 4,580,667 | A | 4/1986 | Herwood | |
| 4,649,974 | A * | 3/1987 | Takanashi | 150/100 |
| 4,674,664 | A | 6/1987 | Simon | |
| 5,007,470 | A | 4/1991 | Freeman | |
| 5,255,833 | A | 10/1993 | McAllister | |
| 5,533,558 | A | 7/1996 | Carey et al. | |
| 5,725,039 | A | 3/1998 | Macinai et al. | |
| 5,782,280 | A | 7/1998 | Berry | |

(Continued)

FOREIGN PATENT DOCUMENTS

| | | |
|---|---|---|
| CH | 562581 | 6/1975 |

(Continued)

*Primary Examiner*—Tri M. Mai
(74) *Attorney, Agent, or Firm*—Schweitzer Cornman Gross & Bondell LLP

(57) ABSTRACT

An improved handbag or the like having one entire side wall formed of a see-through panel which can be selectively exposed to permit facilitated viewing of items contained therein. The see-through panel is joined to an opaque panel to form a receptacle with an access opening at the top. An exterior cover panel of opaque material is removably positioned in covering relation to the see-through panel and at least partially separably attached to the bag structure, allowing the cover panel to be displaced from covering relation to enable facilitated viewing of personal affects through the see-through panel for easy selection and removal.

10 Claims, 4 Drawing Sheets

U.S. PATENT DOCUMENTS

| | | | | |
|---|---|---|---|---|
| 5,829,657 | A | 11/1998 | Romer, Jr. | |
| 6,206,567 | B1 | 3/2001 | Cyr | |
| 6,220,318 | B1 * | 4/2001 | Pinti | 150/103 |
| 6,231,233 | B1 | 5/2001 | Orce | |
| 6,237,660 | B1 | 5/2001 | Giardino | |
| D447,335 | S | 9/2001 | Vazquez | |
| 6,435,391 | B1 | 8/2002 | Vazquez | |
| 6,637,485 | B1 * | 10/2003 | Sartena | 150/118 |

FOREIGN PATENT DOCUMENTS

| | | |
|---|---|---|
| FR | 2406969 | 6/1979 |
| FR | 2584910 A1 | 1/1987 |

* cited by examiner 16
35b
35a
112
14
10

22
16
34b
34a
10
4
4
112
18

HANDBAG OR THE LIKE WITH COVERED, SEE-THROUGH WALL

RELATED U.S. APPLICATION DATA

This is a continuation-in-part of application Ser. No. 10/336,932, filed on Jan. 6, 2003, now U.S. Pat. No. 6,637,485, granted Oct. 28, 2003.

FIELD OF THE INVENTION

The present invention pertains generally to handbags and the like and more particularly, to an improved carrying bag enabling facilitated viewing and retrieval of stored contents.

BACKGROUND OF THE INVENTION

Handbags and the like, which include central openings at the uppermost portion of the bag, are commonly used to carry a plethora of personal articles including cosmetics, keys, paper and coin money, bankbooks, etc. These items are often placed loosely in carrying bags among a variety of other articles and thereby, difficult to locate through the opening of the bag, especially when the user is hurriedly reaching for a particular item therein.

A variety of carrying bags have been devised to promote retrieval of stowed items. Certain of such handbags contain compartments, or pockets, designed to hold numerous individual items. Handbags of this type range from those having a few to a multitude of storage compartments for organized placement of a user's personal affects. While such compartments facilitate organization of items carried within a handbag, an organizational system only facilitates retrieval of items when personal items are actually placed within the provided compartments and when a user remembers where such items are stored. It is well known, however, that since handbags, or other such carrying bags are carried by women at virtually all times, the temptation to indiscriminately toss items in a handbag or the like is often hard to resist. Consequently, compartmentalized carrying bags are not often used in the intended manner, so personal affects remain difficult to see and retrieve, buried within the main storage receptacle.

Accordingly, a primary object of the present invention is to provide a dual function handbag or the like which, while being conventional in appearance and being usable in a conventional manner, also incorporates unique features to facilitate direct viewing and retrieval of items contained within a handbag or the like, permitting effortless access to contained items even in the absence of compartmentalized organization.

A further object of the present invention is to provide a handbag or the like that can be manufactured in a variety of configurations and designs with conventional appearance and function, while still incorporating special features to allow items to be readily viewed and retrieved therefrom.

Another object of the present invention is to enable users to move more quickly through security checkpoints by providing a handbag or the like of improved design, which permits rapid and trouble-free viewing by security personnel.

Yet another object of the present invention is to provide a safe storage area for users, wherein items can be viewed prior to and during retrieval, thereby reducing the potential for a user's hand to be punctured by sharp objects such as nail files, scissors and writing implements.

SUMMARY OF THE INVENTION

The foregoing objects are met by the present invention which is directed to a handbag or the like having a see-through, or at least partially transparent, interior panel which can be selectively exposed to permit facilitated viewing of items contained therein.

Broadly described, the invention includes a bag structure comprised of a first panel connected to a second panel along bottom and side regions, forming a receptacle having a convenient access opening at the top. In accordance with the invention, one of the panels is formed of a see-through material, through which visual access is realized.

In a preferred form, the handbag or the like includes a cover panel dimensioned to extend over the see-through panel, allowing the user to conceal personal affects contained within the bag structure. The cover panel is removably positioned in covering relation to the see-through panel, and at least partially separably attached to the bag structure, so that the cover panel may be easily displaced to view the contents of the bag. Fastening means are employed to releasably secure the cover panel in a "closed" position, to conceal the interior of the bag yet permit displacement thereof for viewing the contents of the bag through the see-through panel when desired.

In accordance with one aspect of the present invention, the cover panel is movable relative to the bag structure between a first position, in which the cover panel is positioned in covering relation to the see-through panel, and a second position, in which the cover panel is displaced from covering relation to enable facilitated viewing of the bag contents through the see-through panel. Accordingly, the handbag construction of the invention allows a user to conveniently displace the cover of the bag to find a desired item amongst a plethora of items loosely contained therein.

According to a further aspect of this invention, the handbag or the like may be manufactured in a variety of styles and designs, including a rounded or straight-edged conventional purse structure, a knapsack, backpack, briefcase, etc., which is comprised of one or more at least partially transparent, or see-through, walls forming the main receptacle of the bag, and a removable cover panel associated therewith which, when closed, gives the bag a conventional appearance and function. When opened, the cover panel provides direct visual access to the entire contents of the bag and also easier physical access to such contents. In addition to providing features which are more convenient and useful to the user, the bag is useful in environments of increased security such as sports arenas, airports, museums and the like wherein bags are customarily searched. The see-through wall panel allows security personnel to quickly visually inspect the entire contents of a user's handbag without inserting their hands therein.

DESCRIPTION OF DRAWINGS

The above and other objects, features and advantages of the present invention will become apparent from the following description of preferred and illustrative embodiments of the invention, taken in conjunction with the accompanying drawings, wherein.

DETAILED DESCRIPTION OF THE PREFERRED EMBODIMENTS

Figure 1:
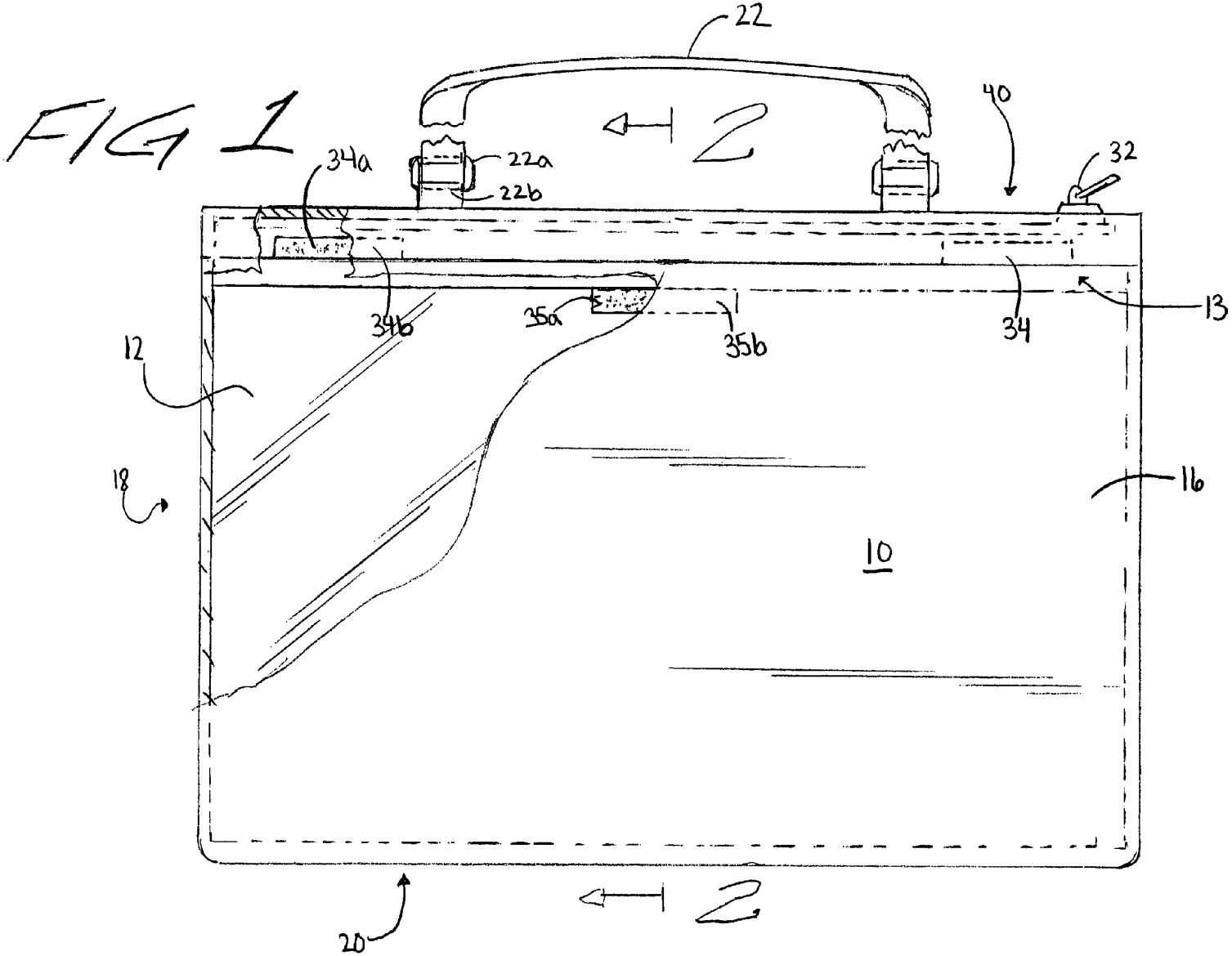
FIG. 1 is a front view of a dual function handbag in accordance with the invention, a portion thereof being broken away to illustrate features of its construction.
Figure 2:
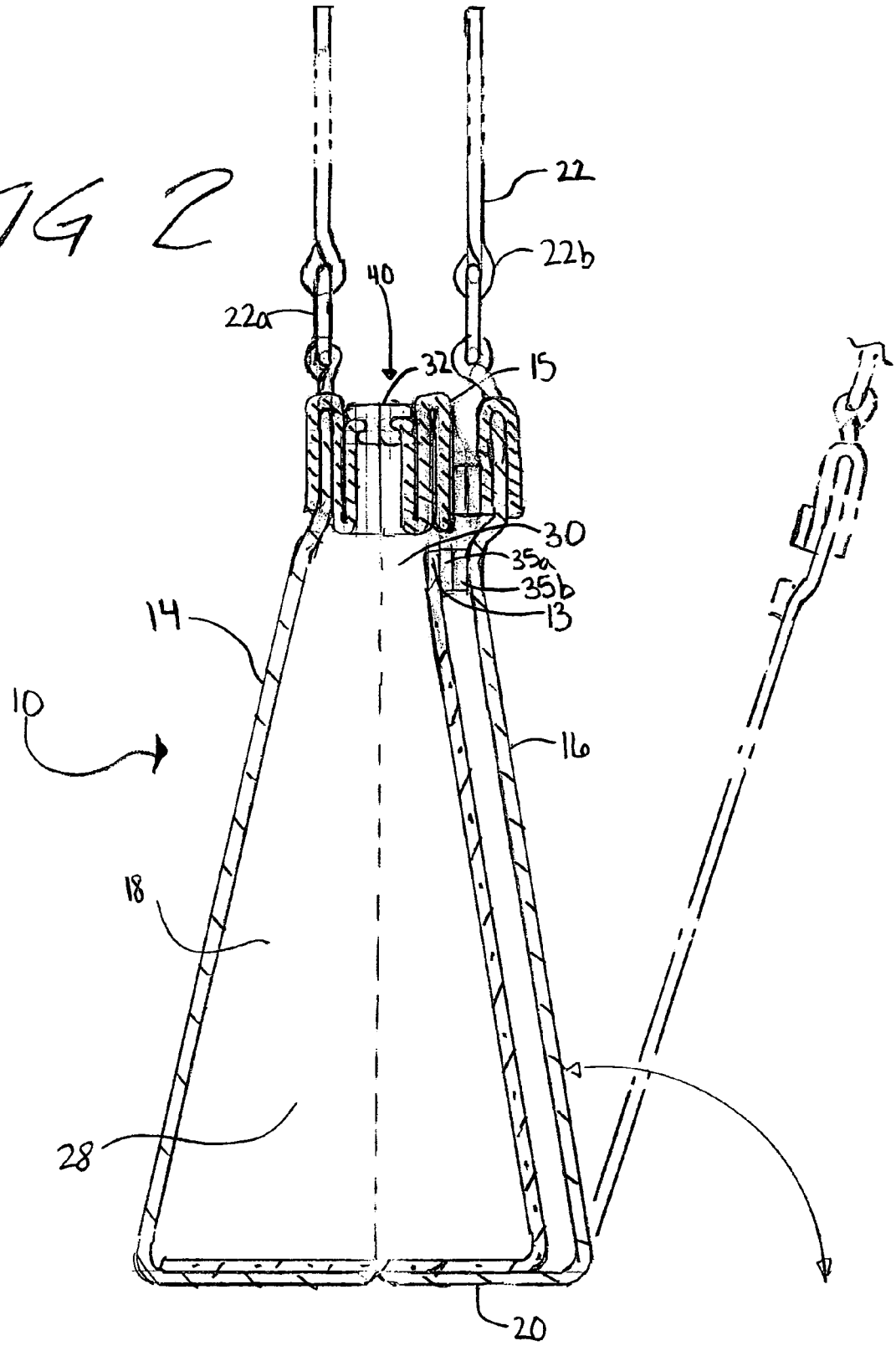
FIG. 2 is a cross sectional view as taken generally on line 2—2 of FIG. 1.

With particular reference to the drawings, and initially to FIGS. 1–2 thereof, the present invention is directed to an improved handbag or the like generally referenced by numeral 10. In accordance with certain aspects of the invention, the handbag structure 10 is shown comprising a see-through first panel 12, preferably formed of transparent or translucent material, positioned between a second panel 14 and a cover panel 16. The handbag 10 is further comprised of dual side panels 18 and a bottom surface panel 20. In a preferred embodiment, most clearly seen in FIG. 2, a carrying strap 22 is connected to the second and cover panels 14, 16 to permit facilitated carrying of the handbag 10 described herein. However, any suitable arrangement may be substituted for the strap 22, including multiple strap members or a handle. In some cases the bag may have no strap, handle or the like.

Preferably, the side panels 18 are integral with and extend from the bottom panel 20. The first and second panels 12, 14 are permanently connected thereto, by any suitable means known in the art, along their respective side and bottom edges to form a receptacle 28 having an access opening 30 through which items may be placed and retrieved. As shown, a zipper closure means 32, located above the access opening 30 is further positioned between the second panel 14 and an opposing upper panel portion 15. Upon moving the zipper into 32 into an open position, an additional access opening 40 into the receptacle 28 is exposed to enable articles to be inserted and retrieved in the usual manner.

In the illustrated and preferred embodiment of FIGS. 1–2, the cover panel 16 is permanently connected to the bottom panel 20 of the bag structure and may be integral with and extend from the second panel 14. The cover panel 16 described herein is dimensioned to completely cover the see-through first panel 12 as well as the upper panel portion 15. Preferably, the upper edges of the cover panel 16 are releasably fastened to the upper panel portion 15 by a suitable fastening means 34, such as hook and loop fasteners (e.g., Velcro), magnets, or buttons, for example. In the illustrated form of the invention, it is preferable to use hook and loop type fastening means comprising parts 34*a*, 34*b*, wherein fasteners 34*a* are mounted on the upper panel portion 15 and opposing fastening means 34*b* are mounted on the interior, or underside, of the cover panel 16.

As shown in the figures, the cover panel 16 is movable relative to the bag structure 10 between a first position, wherein the cover panel 16 is positioned in covering relation to the see-through first panel 12 (FIG. 1), and a second position (FIG. 2), wherein the cover panel 16 is detached from the see-through panel 12 and upper panel portion 15 of the handbag and lifted in an outwardly direction.

As can be seen in FIG. 1, the see-through first panel 12 may be formed of a transparent or translucent, preferably flexible plastic material, whereas the remaining panels of the handbag are formed of any suitable flexible, non-transparent material, including leather, vinyl, and fabric. When the cover panel 16 is in a closed or covering position, the see-through panel 12 and consequently the contents within the bag structure are concealed and may only be retrieved from the handbag 10 when the zipper closure means 32 is in an open position. When the cover panel 16 is in an open position, as shown in FIG. 2, the see-through panel 12 and the access opening 30 are exposed, even if the zipper 32 is closed. Accordingly, items contained within the receptacle 28 may be viewed through the see-through panel 12 and may be placed or retrieved through the access opening 30 formed adjacent the first panel 12 and the upper panel portion 15.

To advantage, an upper edge region of the see-through panel 12 may be separably connected to a portion of the cover panel 16 by a suitable fastening device 35*a*, 35*b*, including hook and loop materials, magnets, etc., to closely hold the first panel 12 adjacent the cover panel 16 when in its first, or closed position, as shown in FIG. 1. In accordance with the invention, when the handbag 10 is accessed in a "conventional" manner by opening the zipper 32, the upper edge 13 of the see-through panel 12 is held snugly against the cover panel 16, allowing the user to insert his or her hand downwardly through the upper access opening 40, more or less as if the see-through panel 12 were not there. However, when the cover panel 16 is separated from the interior, see-through panel 12 to the open position, shown in FIG. 2, the fastening elements 34, 35 on the upper panel portion 15 and adjacent the upper edge 13 of the see-through panel are separated, and the contents of the bag 10 are thus available through the access opening 30 formed above the see-through panel 12, even though the zipper 32 may be closed.

As it is understood in the art, flexible piping (not shown) may be sewn onto the edges of the material surrounding the second and cover panels 14, 16 to enhance the structure and rigidity of the handbag 10.

Typically, the bag structure 10 includes a carrying means, which preferably comprises a shoulder strap 22. The strap 22 is coupled to the bag structure 10 in any manner known in the art. For example, the strap 22, being formed of leather, plastic, or other suitably flexible material, can be engaged at opposite ends by circular rings 22*a* coupled to the second and cover panels 14, 16 by the appropriate means such as flexible loops 22*b*.

Figure 4:
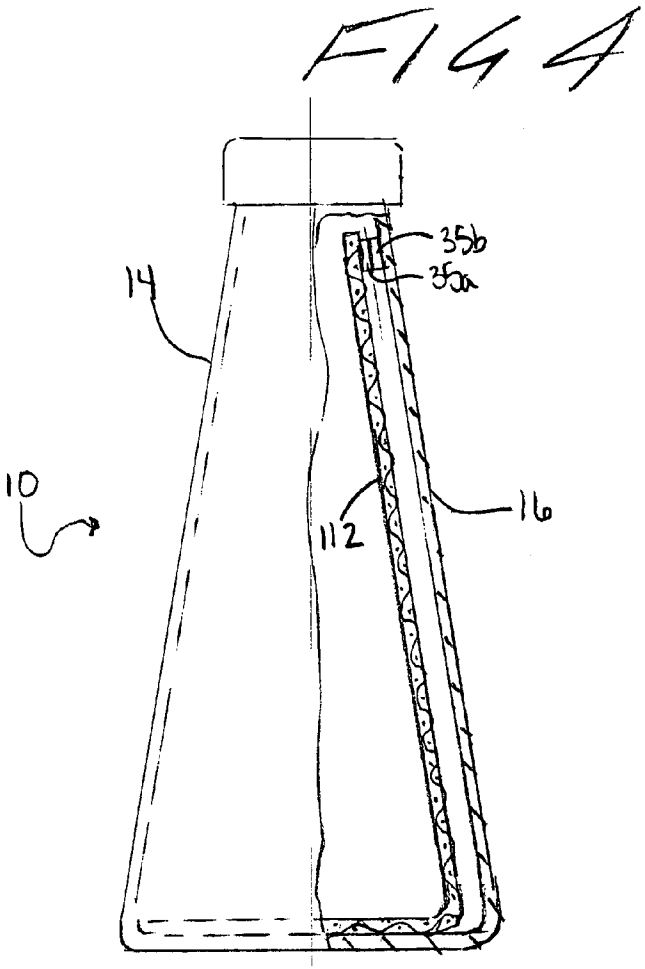
FIG. 4 is a cross sectional view as taken generally on line 4—4 of FIG. 3.
Figure 3:
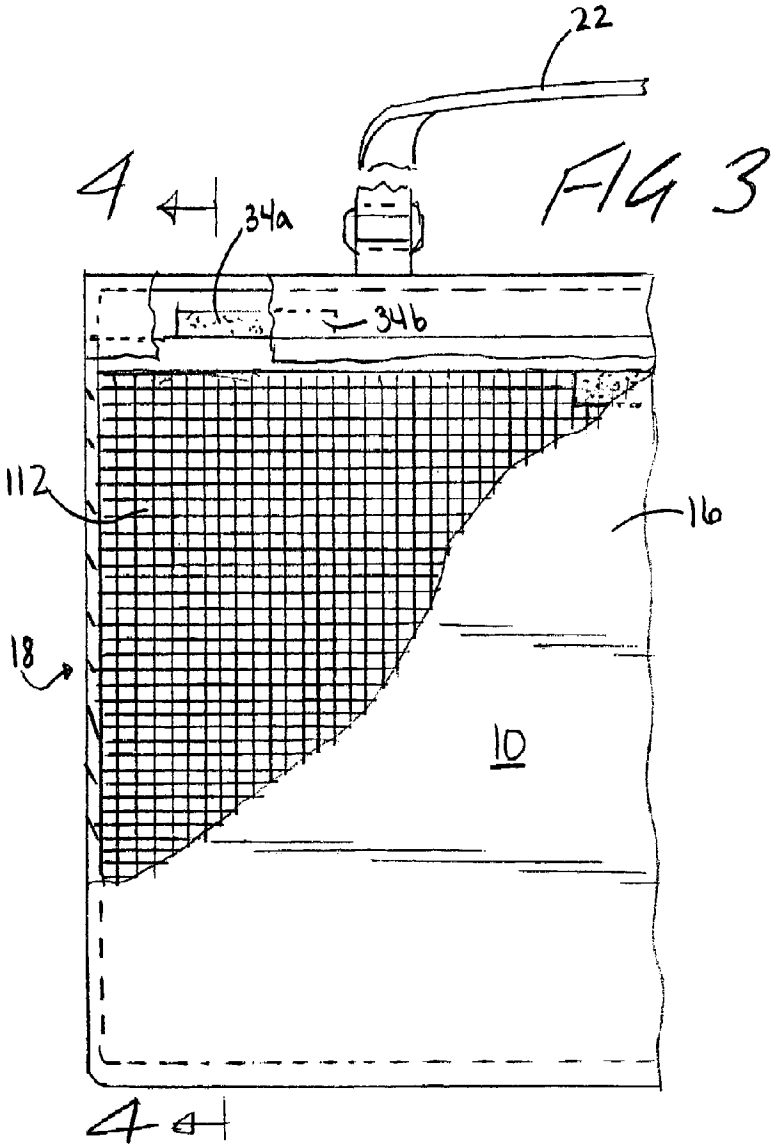
FIG. 3 is a fragmentary front view of another embodiment of a dual function handbag in accordance with the invention, substantially identical to the handbag of FIG. 1, the portion broken away illustrating a partially transparent interior panel formed of a mesh material.

An additional embodiment of the present invention is depicted in FIGS. 3 and 4 wherein similar elements to those shown in FIGS. 1 and 2 are referenced by the same numerals. As can be seen, the handbag 10 may include a see-through first panel 112, comprised of a webbed or mesh material, for example, that allows light to penetrate through so that the contents of the handbag 10 are readily visible when the cover 16 is in the second, or open, position. Preferably the mesh material is of a suitable size for retaining small items within the storage receptacle, while still enabling items to be readily viewed through the orifices within the material. As would be apparent to one skilled in the art, any material or combination thereof having suitable see-through characteristics is within the scope of the invention.

Figure 5:
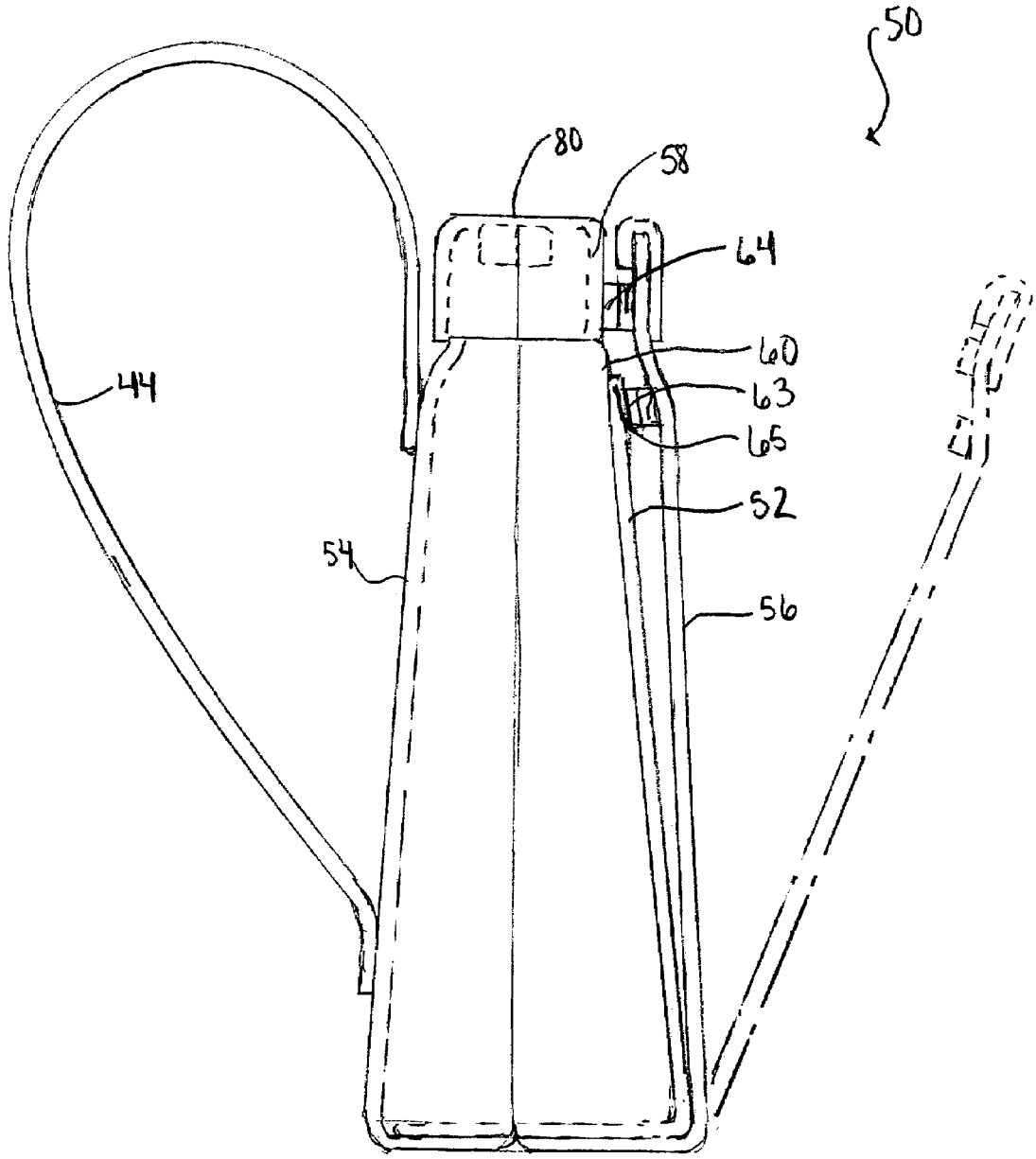
FIG. 5 is a sectional view of an additional embodiment of the invention in which the features of the invention are incorporated into a backpack.

Referring now to FIG. 5, an alternative embodiment in accordance with the invention described herein, is shown in the form of a backpack 50. Desirably, dual elongated straps 44 are secured to the second panel 54, forming convenient over-the-shoulder carrying straps. To advantage, a carrying handle may also be provided at the top of the backpack 50 as an alternative to carrying the backpack over the shoulders, using the straps 44.

In the backpack 50 of FIG. 5, a cover panel 56 is releasably secured to the backpack 50 and movable between first and second positions generally in the same manner as the cover panel 16 of the first described embodiment. The upper portion of the cover panel 56 is releasably secured to corresponding areas of a see-through panel 52 and an upper panel portion 58 of the backpack by hook and loop fasteners 63, 64 for example.

When the cover panel 56 is closed, contents of the backpack 50 can be viewed and retrieved only through the uppermost access opening 80, between upper panel portion 58 and second panel 54, and the contents of the bag are concealed from view except when viewing downward through the access opening 80. When the cover panel 56 is lifted outward, separating the releasable attachments 63 and 64, the entire see-through panel 52 is exposed, including its upper edge 65, so that all of the contents are visible. An object thus may be retrieved through the exposed access opening 60, while simultaneously viewing the entire contents of the bag through the see-through panel 52.

The present invention provides a handbag or the like having at least one wall formed of a see-through panel, which is normally covered by an opaque removable cover panel. The cover panel can be conveniently displaced to facilitate direct viewing and retrieval of objects contained within the storage receptacle. Additionally, the handbag or the like described herein can be manufactured in a variety of designs to accommodate any style.

When the cover panel of the described handbag, backpack or the like is in its closed or covering position, the bag has the appearance of being an entirely conventional bag, accessible only in the customary way, by opening a zipper, clasp, draw string or other closure means at the top of the bag to provide both visual and manual access in the conventional manner, only through the top of the bag. When the cover panel is pulled away from the see-through panel concealed behind it, the entire contents of the bag are readily visible through the see-through panel, which forms the entire receptacle side wall, while manual access to the contents of the bag is provided through the access opening (30, 60) defined in part by the upper edge (13, 65) of the see-through panel. A particular advantage of this arrangement is that the user of the bag may easily see the entire contents thereof from the side of the bag, while simultaneously reaching in through an access opening to retrieve a particular object. As will be readily appreciated, this greatly facilitates recovery of a specific item from the typical jumble of miscellaneous items typically found in a handbag.

Another advantageous feature of the invention is that it can significantly expedite security checks, which are becoming more common and, to some extent more thorough, at airports and other public locations. With the handbag or the like of the invention, the cover panel may be pulled away such that the entire contents of the bag made readily visible to the security attendant. The attendant may also easily insert a hand into the bag while continuing to view its contents so as to be confident that the entire contents of the bag have been viewed. By contrast, with a conventional bag, all or a portion of the contents of the bag may have to be removed therefrom in order for the security attendant to have a similar level of confidence that the inspection has been effectively accomplished.

Various modifications to the embodiments described herein will be readily apparent to those skilled in the art. For instance, the cover panel need not be releasably connected directly to the see-through panel and to the upper panel portion of the bag to securely attach the cover panel thereto. Rather, the cover panel may be constructed to be releasably attached to either side panel. As will be readily appreciated the invention may be applied to almost any kind of carry bag, including briefcases, school bags, carry-on luggage, and the like. For the foregoing reasons, the scope of this invention is to be defined by reference to the appended claims.

What is claimed is:

1. A handbag or the like enabling facilitated viewing and retrieval of contents comprising:

(a) a bag structure having at least first and second panels forming a primary receptacle for carrying personal effects, a top structure defining a primary access opening at the top and a closure means for said primary access opening;

(b) said first panel being formed of see-through material providing visual access, through said first panel, to the contents of the bag;

(c) an upper edge of said first panel being detached from said top structure, at least in central portions thereof, to form a secondary access opening into said receptacle, (d) a cover panel removably positioned in covering relation to said first panel to block said visual access, (e) said cover panel being at least partially separably attached to said top structure independently of said closure means to enable said cover panel to be displaced from said covering relation for viewing said contents through said first panel and accessing said contents through said secondary access opening.

2. The handbag or the like of claim 1, wherein (a) said first panel is made of transparent, flexible plastic.

3. The handbag or the like of claim 1, wherein (a) said first panel is made of mesh material.

4. The handbag or the like of claim 1, having (a) one or more fasteners for releasably fastening said cover to said top structure, (b) said cover being movable between a first position, wherein said cover is positioned in said covering relation, and a second position, wherein said cover is displaced from said covering relation to provide said access.

5. The handbag or the like of claim 1, wherein said first and second panels are connected to opposing edges of two side panels and a bottom panel.

6. The handbag or the like of claim 1, wherein (a) said cover panel is permanently secured along its bottom edge to said bag structure, and (b) a carrying means is coupled to the second panel and said cover panel.

7. The handbag or the like of claim 6, wherein said carrying means consists of at least one strap.

8. The handbag or the like of claim 1, wherein said first panel is dimensioned to provide see-through coverage over substantially an entire surface of said second panel.

9. The handbag or the like of claim 1, wherein (a) the distance between opposing upper and lower edges of said first panel is substantially equal to the distance between opposing upper and lower edges of said second panel.

10. A handbag or the like enabling facilitated viewing and retrieval of contents comprising:

(a) a bag structure having at least first and second panels forming a primary receptacle for carrying personal effects, a top structure defining a primary access opening at the top and a closure means for said primary access opening;

(b) said first panel being formed substantially of see-through material providing visual access, through said first panel, to the contents of the bag;

(c) an upper edge of said first panel being detached from said top structure, at least in central portions thereof, to form a secondary access opening into said receptacle, (d) a cover panel removably positioned in covering relation to said first panel to block said visual access, (e) said cover panel being at least partially separably attached to said top structure independently of said closure means to enable said cover panel to be displaced from said covering relation for viewing said contents through said first panel and accessing said contents through said secondary access opening.

* * * * *